US011713878B2

(12) United States Patent
Lewis

(10) Patent No.: US 11,713,878 B2
(45) Date of Patent: Aug. 1, 2023

(54) METHOD AND MOBILE APPARATUS FOR IMPROVING IN-SITU COMBUSTION OF A COMBUSTIBLE MATERIAL LYING ON NOMINALLY PLANAR SURFACE

(71) Applicant: F. Michael Lewis, El Segundo, CA (US)

(72) Inventor: F. Michael Lewis, El Segundo, CA (US)

( * ) Notice: Subject to any disclaimer, the term of this patent is extended or adjusted under 35 U.S.C. 154(b) by 281 days.

(21) Appl. No.: 17/169,299

(22) Filed: Feb. 5, 2021

(65) Prior Publication Data

US 2022/0252259 A1 Aug. 11, 2022

Related U.S. Application Data

(60) Provisional application No. 62/995,039, filed on Jan. 8, 2020.

(51) Int. Cl.
*F23G 5/40* (2006.01)
*F23G 5/50* (2006.01)
*F23G 5/32* (2006.01)

(52) U.S. Cl.
CPC ..... *F23G 5/40* (2013.01); *F23G 5/32* (2013.01); *F23G 5/50* (2013.01); *F23G 2203/60* (2013.01); *F23G 2207/102* (2013.01); *F23G 2207/30* (2013.01)

(58) Field of Classification Search
CPC ..... F23G 5/40; F23G 5/32; F23G 5/50
See application file for complete search history.

(56) References Cited

U.S. PATENT DOCUMENTS

| | | | | | |
|---|---|---|---|---|---|
| 1,850,822 | A | | 3/1932 | Young | |
| 2,417,445 | A | | 3/1947 | Pinkel | |
| 2,936,724 | A | | 5/1960 | Bishop | |
| 3,030,773 | A | * | 4/1962 | Johnson | F23R 3/14 60/749 |
| 3,145,670 | A | * | 8/1964 | Copian | F23D 1/00 431/284 |
| 4,018,543 | A | | 4/1977 | Carson | |
| 4,297,094 | A | * | 10/1981 | Reed | F23G 7/085 431/202 |

(Continued)

FOREIGN PATENT DOCUMENTS

EP 0614056 B1 2/1994

*Primary Examiner* — Jason Lau
(74) *Attorney, Agent, or Firm* — Bryan E. Johnson, Esq.

(57) ABSTRACT

A method and apparatus, for improving the control and the efficiency of in-situ combustion (i.e. burning of oil spills atop bodies of water) of combustible waste materials on land or sea to cleanup such waste, that is also less complex than similar apparatuses, whereby the apparatus traverses over a surface containing combustible material, allowing for vortex flow incineration of the material to occur inside a combustion chamber, aided by a vortical flow of air which is controlled for greater combustion efficiency. Compared with current methods and apparatuses to cleanup similar waste, the present method requires minimal moving parts, is mobile, is low cost, is easy to construct, enables high-quality combustion, burns faster and more complete, produces low emissions, incinerates waste material on land and water, and mitigates the creation of combustion residue which thereby mitigates the adverse effects of such combustion residue that smothers ocean life.

12 Claims, 10 Drawing Sheets

PERSPECTIVE PLAN VIEW OF THE APPARATUS

(56) References Cited

U.S. PATENT DOCUMENTS

| | | | | |
|---|---|---|---|---|
| 6,109,863 | A | 8/2000 | Milliken | |
| 6,772,593 | B2 | 8/2004 | Dunn | |
| 7,086,823 | B2 | 8/2006 | Michaud | |
| 7,438,003 | B2 * | 10/2008 | Wilfer | F23G 5/42 110/224 |
| D621,873 | S * | 8/2010 | Tsai | D19/26 |
| 8,517,719 | B2 * | 8/2013 | Briggs, Jr. | F23C 7/006 431/185 |
| 9,726,368 | B2 * | 8/2017 | Chen | F23D 3/20 |
| 10,989,410 | B2 * | 4/2021 | Chen | F23R 3/06 |
| 2012/0040296 | A1 * | 2/2012 | Ashline | F23G 7/05 431/8 |
| 2013/0202357 | A1 * | 8/2013 | Champ | E02B 15/0821 405/63 |
| 2013/0263766 | A1 * | 10/2013 | Goruney | F23N 5/003 110/297 |
| 2020/0056785 | A1 * | 2/2020 | VanNatta | F23G 5/24 |

* cited by examiner

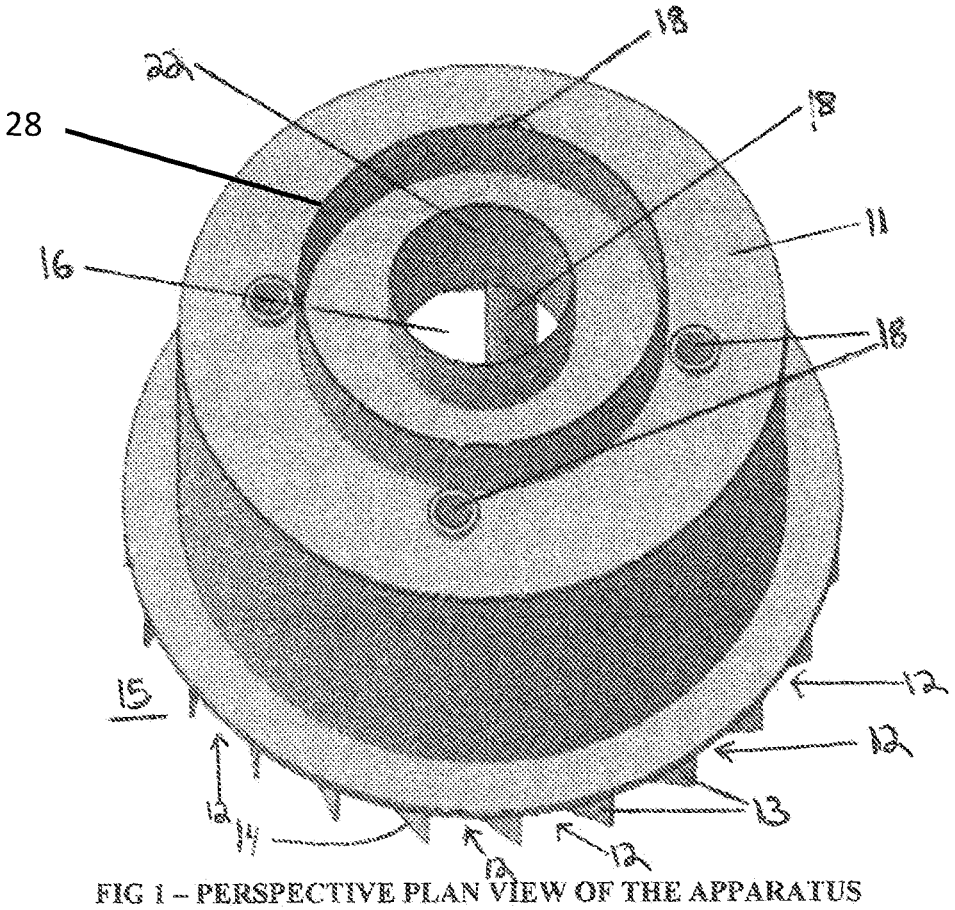
FIG 1 – PERSPECTIVE PLAN VIEW OF THE APPARATUS

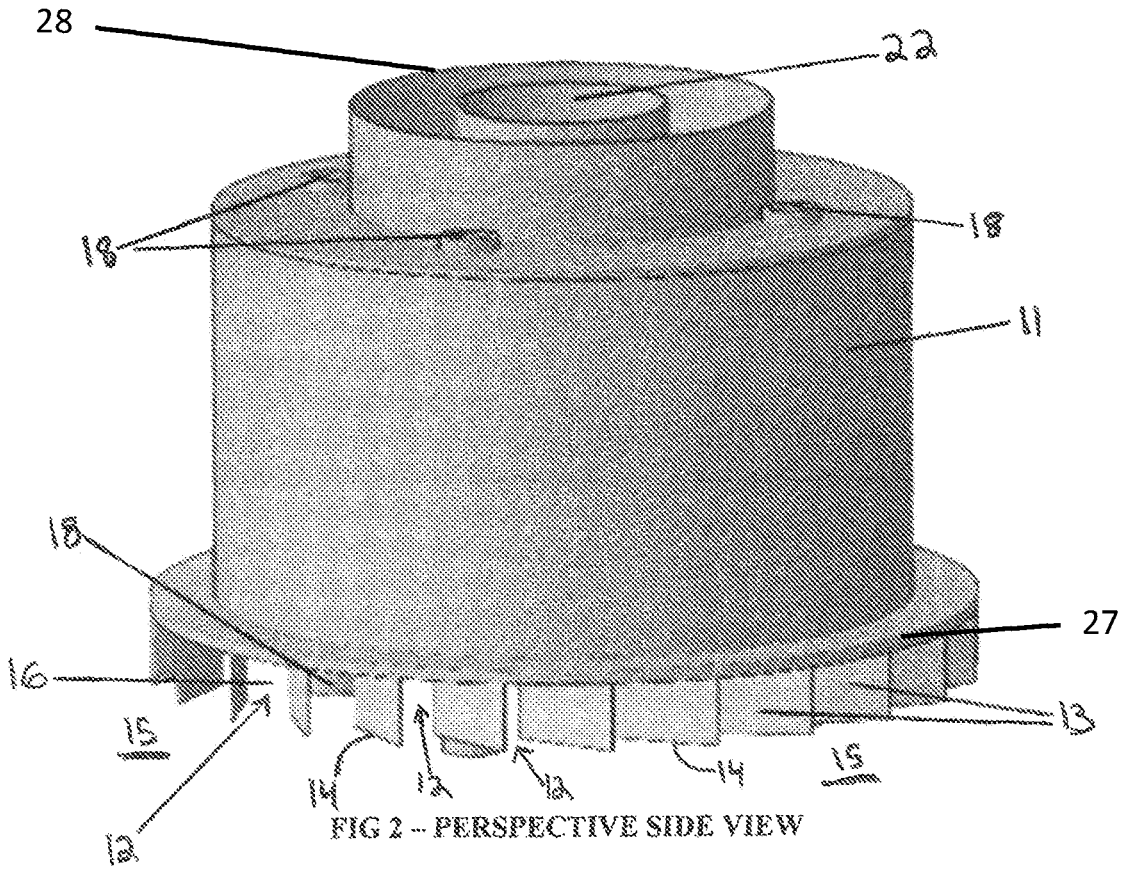
FIG 2 – PERSPECTIVE SIDE VIEW

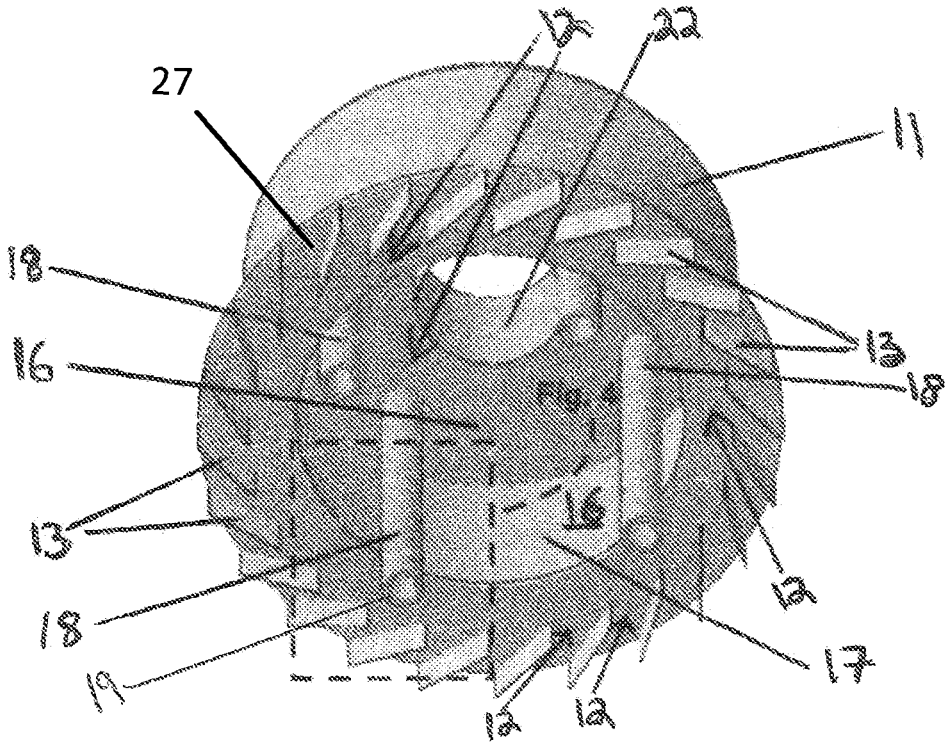
FIG 3 – PERSPECTIVE BOTTOM VIEW

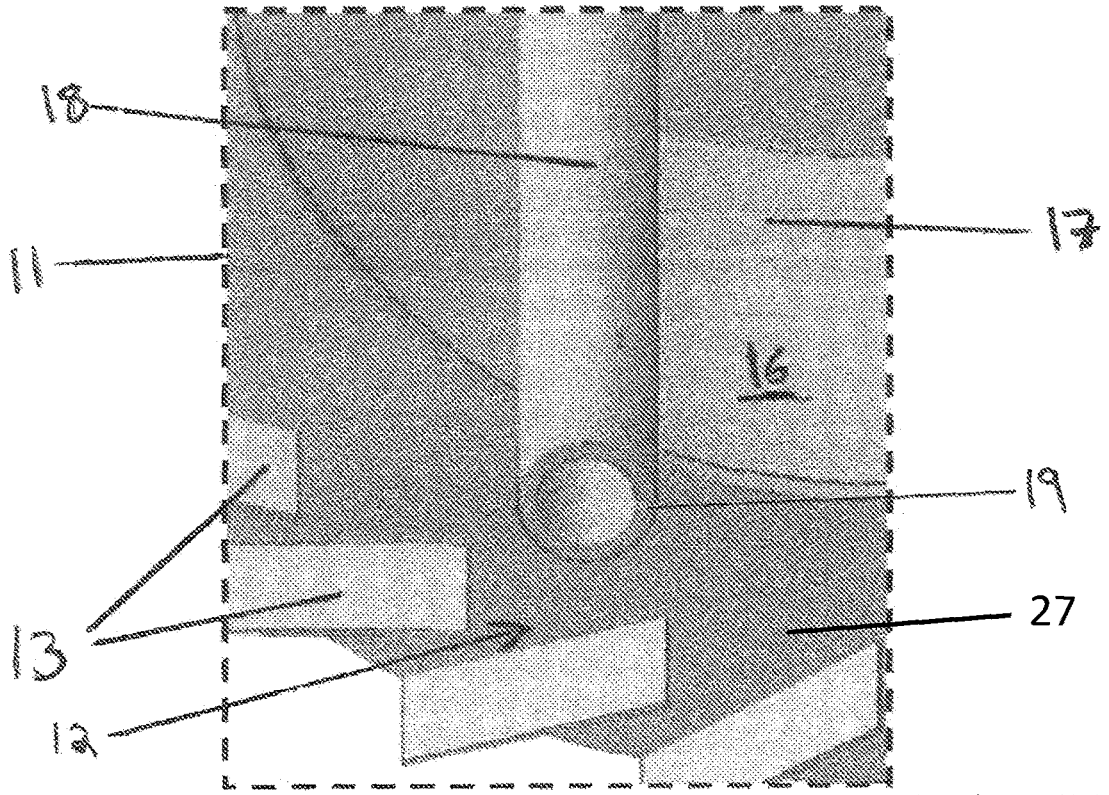
FIG 4 – A PORTION OF A VIEW OF FIGURE 3 ENLARGED FOR MAGNIFICATION PURPOSES

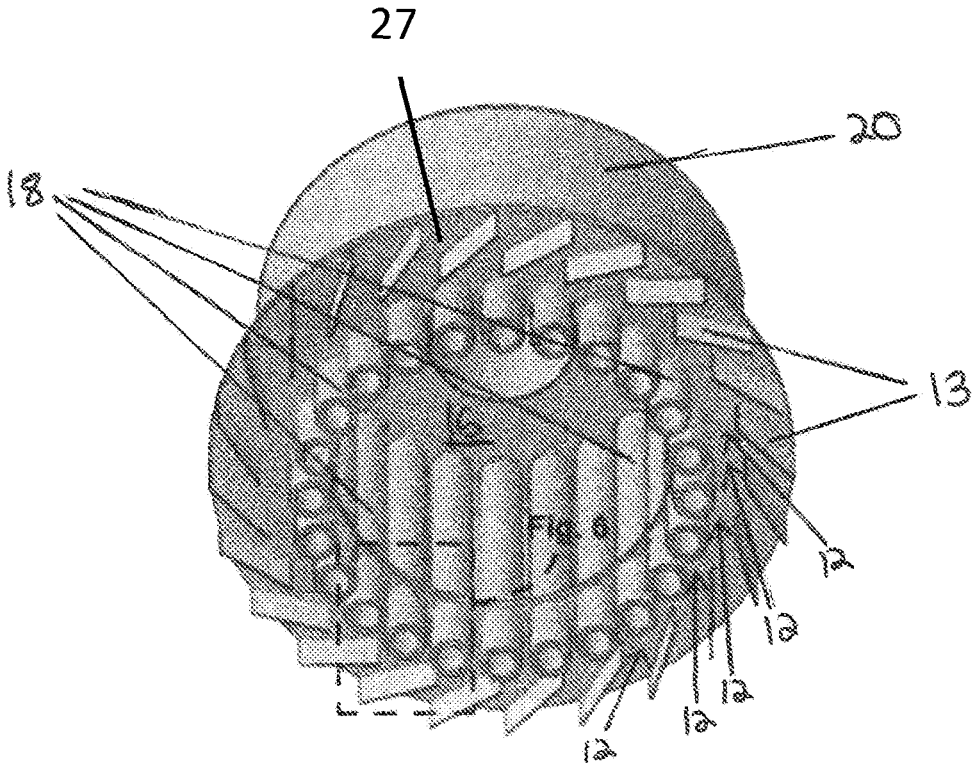
FIG 5 – A PERSPECTIVE BOTTOM VIEW OF AN EMBODIMENT OF APPARATUS WITH BLUFF BODY

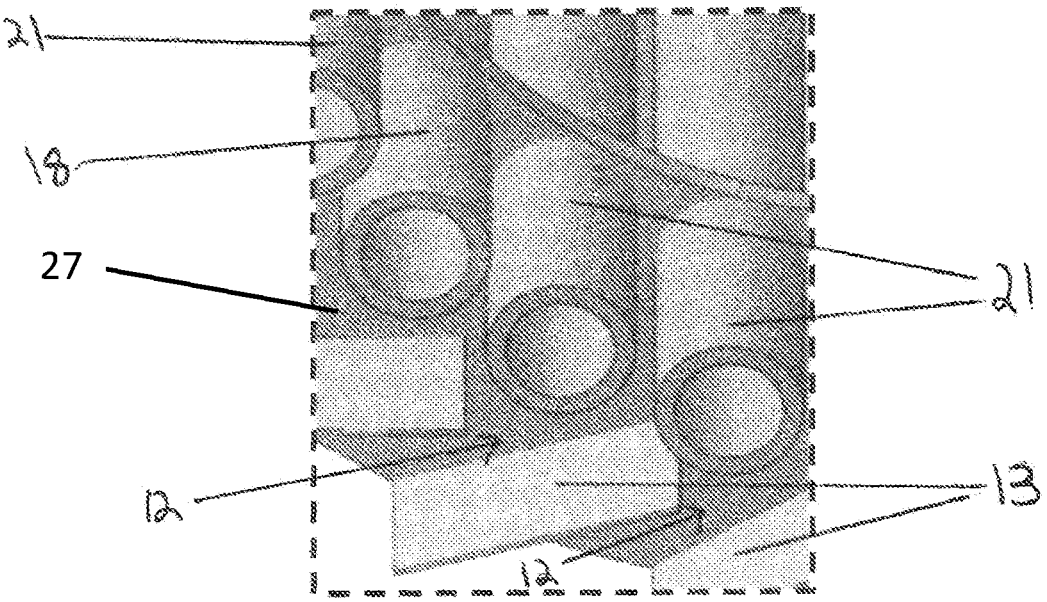
FIG 6 – A PORTION OF A VIEW OF FIGURE 5 ENLARGED FOR MAGNIFICATION PURPOSES

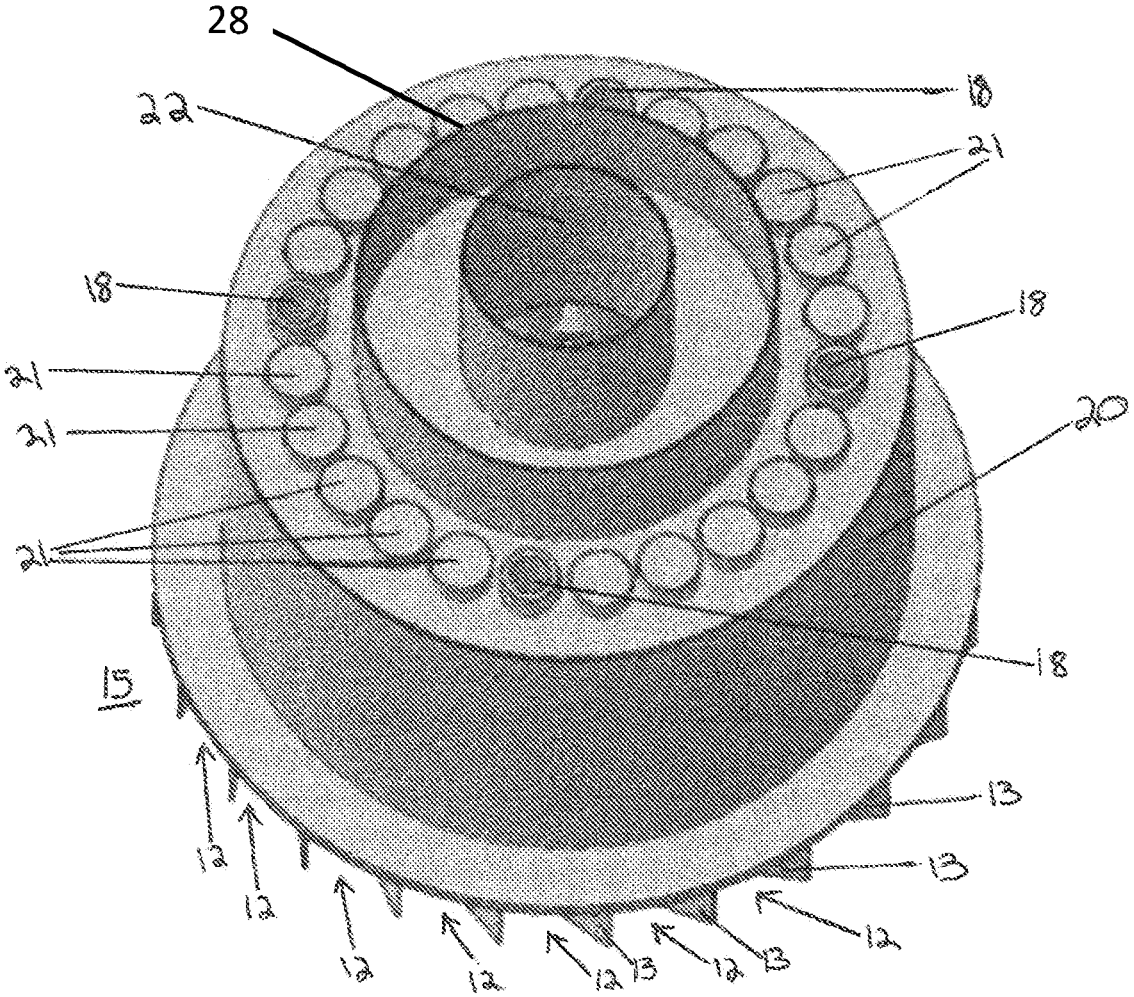
FIG 7 – PERSPECTIVE PLAN VIEW OF AN EMBODIMENT OF APPARATUS WITH BLUFF BODY

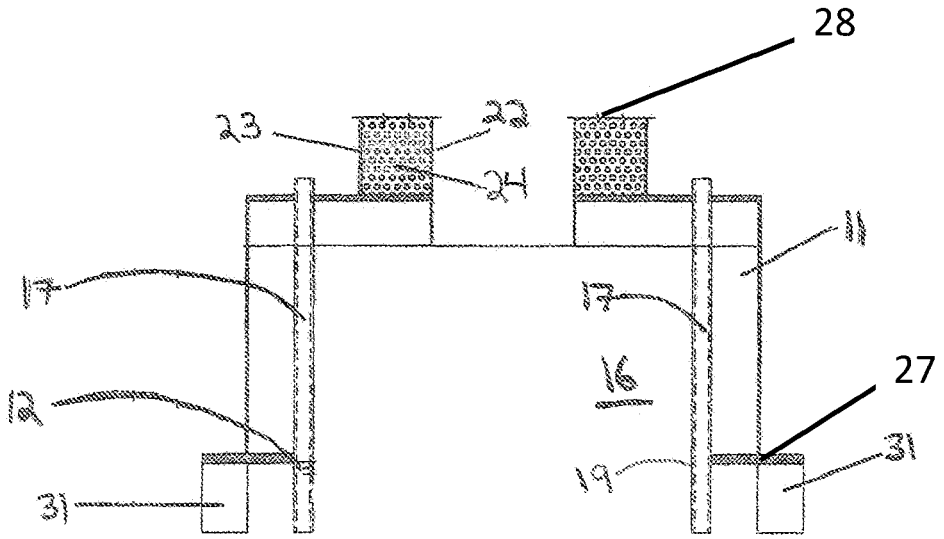
FIG 8 – LONGITUDINAL SECTION VIEW OF THE APPARATUS

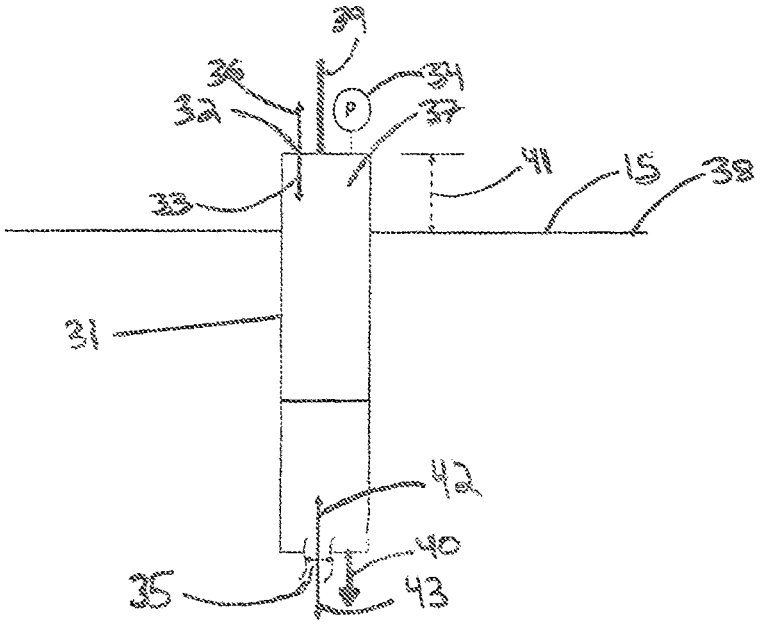
FIG 9 – LONGITUDINAL SECTION VIEW OF THE BALLAST TANK

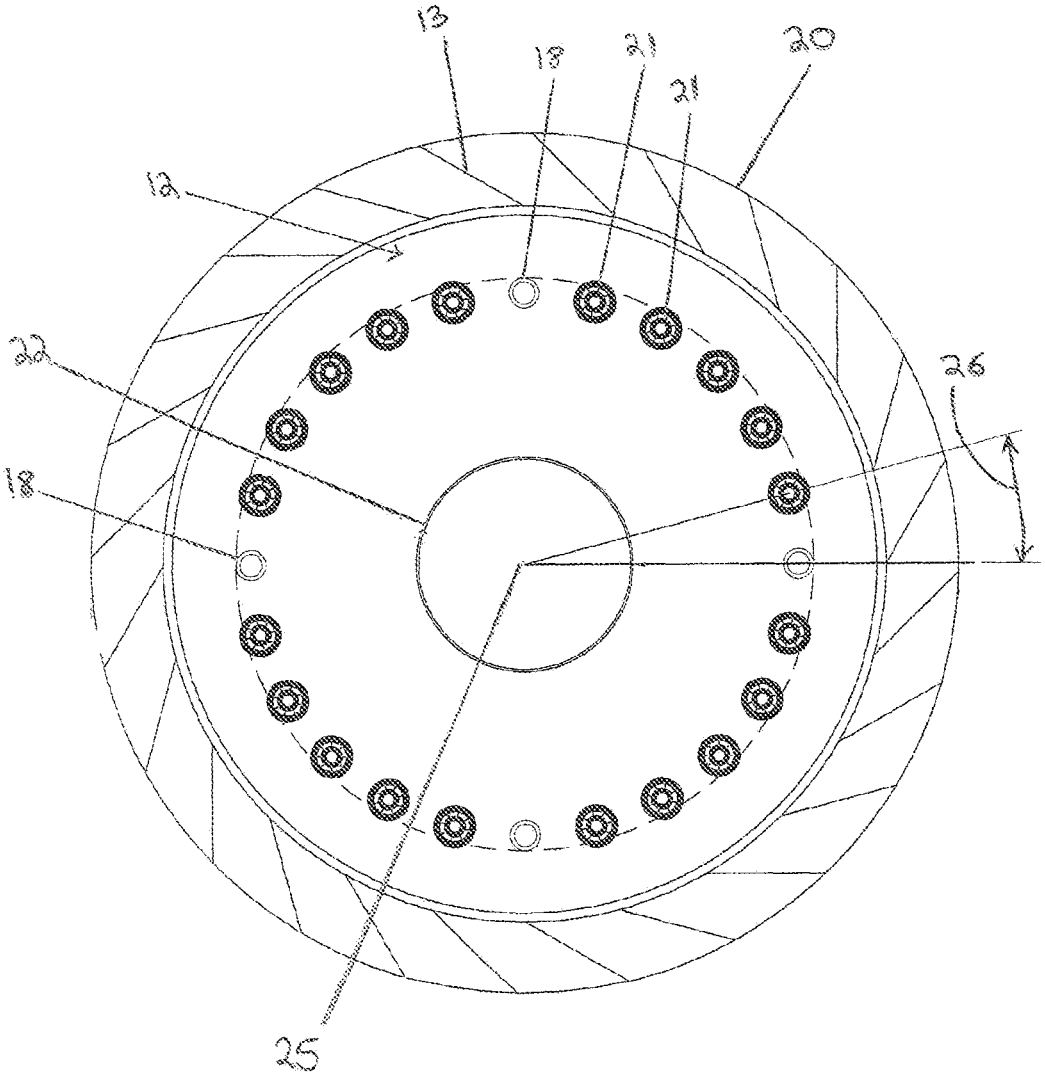
FIG 10 - TOP VIEW OF THE APPARATUS WITH BLUFF BODY

METHOD AND MOBILE APPARATUS FOR IMPROVING IN-SITU COMBUSTION OF A COMBUSTIBLE MATERIAL LYING ON NOMINALLY PLANAR SURFACE

CROSS-REFERENCE TO RELATED APPLICATIONS

This application claims the benefit of U.S. Provisional Patent Application No. 62/995,039.

FEDERALLY SPONSORED RESEARCH

None.

SEQUENCE LISTING

None.

INVENTOR

F. Michael Lewis

BACKGROUND

Prior Art

The following is a tabulation of some prior art that presently appears relevant:

U.S. Patents

| Pat. No. | Priority Date | Inventor |
|---|---|---|
| 7,086,823 B2 | Sep. 19, 2001 | Michaud |
| 3,030,773 | Jan. 22, 1959 | Johnson |
| 6,109,863 | Nov. 16, 1998 | Milliken |
| 2,936,724 | Jun. 4, 1958 | Bishop |
| 6,772,593 B2 | May 7, 2001 | Dunn |
| 4,018,543 | Sep. 19, 1975 | Carson |
| 2,417,445 | Sep. 20, 1945 | Pinkel |
| 1,850,822 | Oct. 10, 1930 | Young |

Foreign Patent Documents

| Pat. No. | Priority Date | Inventor |
|---|---|---|
| EP0614056 B1 | Feb. 24, 1994 | Kotoh |

Other Publications

Forster, Robin, a dissertation submitted in partial fulfilment of the requirements for the degree of Doctor of Philosophy at the University of Surrey, Department of Chemical and Process Engineering, School of Engineering in the Environment, University of Surrey, "CFD Modeling of Vortex Combustors" (1999), pp. 21-37.

Golley, John, "Genesis of the Jet; Frank Whittle and the Invention of the Jet Engine", Vol. 12 (1996).

Hurley, T. F., J. Inst. Fuel, 4, "Some Factors Affecting the Design of Small Combustion Chamber for Pulverised Fuel" (1931), p. 243.

Lewis, F. Michael, Stanford Research Institute, "A Scrap Tire-Fired Boiler" (1976), pp. 301-311.

BACKGROUND

Incineration is a waste treatment process that involves the combustion (i.e. burning) of organic substances contained in waste materials. Incineration of waste materials converts the waste into ash, flue gas, and heat. This invention is in response to the growing international demand for an effective, efficient, inexpensive, clean, and mobile method of incineration of waste disposal on land and on sea to curb environmental pollution problems. This invention is intended to cleanly incinerate a waste material lying on a nominally flat, planar (i.e. flat plane) surface—be it land or water—where the invention traverses over a surface containing waste material, and then completes combustion of the waste material in a combustion chamber, labeled as the Central Core Combustion Chamber (CCCC), and driven by a natural and turbulent draft of fresh combustion air, with exhaust occurring out an insulated stack.

Various methods currently exist to dispose of waste, such as dumping and covering waste, microbiological degrading, chemical neutralizing, and incinerating. Each method of disposal comes with its various challenges to its efficiency and effectiveness. This present method and mobile apparatus is related to the incineration method of waste disposal, namely vortex flow incineration at the CCCC, which produces gases that are released to the atmosphere. The use of swirl to create recirculation zones also aids in producing a stable flame. Presently, there currently exists a need for a low-emission, clean, high quality combustion of a heterogeneous layer of waste, from a mobile apparatus that is functional on both land and sea, that is low cost, that has minimal moving parts, that is easy to construct, with a control mechanism over the air to fuel ratio (which in turn governs the theoretical flame temperature)—which this method and mobile apparatus provides.

Various applications could use such an invention as a tool for their respective needs, such as a tool for the efficient in-situ combustion of oil-spills, or as a tool in the incineration of out-of-date military munitions. There are billions of tons of waste floating on the ocean that need disposal. This invention and its function has been aided by the study of "vortex combustion" and "cyclonic combustion chambers", and their use as an effective form of combustion. Moreover, traditional methods for in-situ cleanup of oil spills (i.e. skimmers or chemical dispersants) can harm marine life and have been found to be less effective than incinerating the fuel.

Cyclonic combustion has been well-known in its disastrous form, via firewhirls, during wildfires, where a whirlwind is induced by a fire, which start from turbulent whirling wind conditions that combine with intense rising heat to form whirling eddies of air, which suck in debris and combustible gases. Firewhirls can reach up to 2,000 degrees Fahrenheit. One of the first references to the idea and construction of a cyclonic combustion chamber is that of Hurley in 1930. He was the first to explain the principle of the two forces, drag and centrifugal, which are present, and how these forces could be used to obtain a relative movement between the fuel particles and air. He then went on to design and build a cyclone combustor based on these principles. In the line of development of cyclonic combustors came the use of a cyclonic field to promote high intensity combustion in Whittle's first jet engine, and virtually all jet engine cans since 1940.

In studying these cyclonic combustion chambers, a method of cleaning oceanic oil spills that has been found to be effective has been lighting a fire on top of it, in a manner to recreate those same forces of cyclonic combustion, but on water.

Incinerating fuel on water, through the use of in-situ cyclonic combustion has been found to be one of the most efficient methods of incinerating hydrocarbon fuel, because it produces drastically increased heating to the surface of fuels, allowing them to burn faster and more complete, and greatly reduce airborne emissions.

In-situ combustion, which is also known as in-situ burning (i.e. burning of oil spills atop bodies of water), which in itself is considered environmentally undesirable, is nevertheless essentially standard practice for the incineration of out-of-date military munitions (demil) on land, and oil spills on lake or ocean waters. This in-situ combustion is characterized as incomplete and easily recognizable by the large clouds of dense black or dark smoke emitting from the fire base. Additionally, in-situ combustion has a great impact on life on the ocean floor, where smothering of this life can occur from the residue resulting from in-situ combustion that sinks to the bottom of the ocean floor. The more complete and efficient the combustion, then the creation of combustion residue is mitigated, thereby decreasing the adverse effects of smothering of the life on the ocean floor by that sinking residue.

While the technology for complete and clean combustion of similar materials is definitely available, it requires stationary buildings and structures, and is hugely expensive. Moreover, past prohibitive elements of similar methods and apparatuses used for the complete and clean combustion of similar materials and products, include a large number of moving parts, complex construction requirements, complex operation requirements, and high costs of production.

It has been a challenge for those skilled in the art of clean combustion technology to create a method and mobile apparatus for the effective, efficient, complete, and clean combustion of materials, such as military munitions and oil spills, that can be fabricated for significantly less cost than a hazardous waste incinerator, that has minimal number of moving parts, that is simple to construct and operate, and that is able to move over the waste material. There are various stages of the process of combustion of oil where inefficiencies in combustion could exist. Specifically, for oil to be combusted, the majority of it must be vaporized and then burned as a gas. There may be some fixed carbon residue remaining, and this must reach an ignition temperature so it can react with the oxygen in the air.

In-situ combustion of waste materials, within a combustion chamber, and the effectiveness and efficiency thereof, can be greatly hindered by the ineffectiveness and inefficiency of the introduction of air into the combustion chamber, along with the turbulence of the air, where the effectiveness and completeness of combustion is directly related to the kinetics and relative movement between the air for combustion and the fuel. It is therefore highly desirable to effect control over the kinetics and movement between the air for combustion and the fuel, which can be done through control of the volume, direction, and turbulence of the inlet air into the combustion chamber.

Additionally, the efficiency of in-situ combustion of waste material, such as crude oil on water, can be greatly influenced by the surface temperature upon ignition and the combustion rate of crude oil, which has a practical correlation to the ignitability of the oil slick. Once spilled, the oil wilt lose its volatile components, mix with water to form water-in-oil emulsions and spread out, decreasing the slick thickness. These events all contribute to decreasing the efficiency of the combustion of waste material. Once a spill oil is ignited, it is important that a high combustion efficiency is obtained to remove as much of the oil as possible. It is therefore highly desirable to effect control over the combustion efficiency of the apparatus, which is aided in this invention through feed pipes of auxiliary fuel to the combustion chamber and waste material.

A method used to control the vortex flow of air into CCCC is the increasing or decreasing of the annular gap between the control vanes located at the radial end of the base of the CCCC. The increasing or decreasing of the annular gap is done by changing the height of the CCCC, which modifies the exposure of the vanes to the air at the base of the CCCC.

The present invention consists of a cylindrical combustion chamber containing a burner nozzle for combustible gas therein, which is open at the top for flue gas discharge through a hot, insulated stack, and open at the bottom for air intake through the annular gaps, to support clean combustion.

Combustion occurs within the CCCC containing an ignition means for combustion for the air and fuel mixture within the combustion chamber. Inside the chamber it is necessary to supply air required for the combustion of waste gas. The supply of air is introduced through air intake annular gaps circumferentially placed around the lower part of the chamber. Fresh combustion air and turbulence is powered by a non-forced draft, created in the hot, insulated stack of the apparatus, where flue gas from the combustion in the CCCC ascends up into.

It is acknowledged that incinerator arrangements of various types are well known to the prior art, however these types of units are more burdened with structural features that make them cost prohibitive.

SUMMARY OF THE INVENTION

The instant method and mobile apparatus improves the control and limits the complexity of combustion methods and apparatuses, in the field of combustion technology, and therefore reduces their costs, while increasing their usefulness. The present and novel method for improving the control of combustion methods and mobile apparatuses comprises the use of a central combustion chamber and a hot, insulated stack tower, in which an efficient combustion of a waste material occurs within the tower by admitting air tangentially at the base of the tower's wall, where there also exists an ignition source.

The instant method and mobile apparatus provides a novelty in the field of combustion that those skilled in the art have longed for, which is an efficient, effective, clean, and complete combustion incinerator, where combustion efficiency is maximized by a novel control mechanism for the air intake by varying the height of the reactor above the surface thereby changing the air flow cross-sectional area, which therein controls the efficiency of combustion.

The instant method and mobile apparatus provides a cylindrical combustion chamber that contains an inwardly spiraling vortex air-flow, created by the natural draft of tangential air flow, through annularly positioned deflecting swirl vanes, located radially at the base of the cylindrical combustion chamber. A vortex air flow is created by deflecting vanes set at an angle relative to the tangent of the outer radius of the cylindrical tower. The air entering the annular gap between the swirl vanes is controlled by varying the height of the annular gap between the swirl vanes, by raising the mobile apparatus to expose more of the swirl vanes The height of the annular gap between the swirl vanes is varied by a level control means, where a controlled force applies upward pressure on the apparatus to counter the downward pressure of the cylindrical combustion chamber and the stack, which raises the apparatus to expose more height of the swirl vanes. A preferred embodiment of this level control means, for use in a water application of the invention, is the use of hollow cylindrical ballast tanks uniformly positioned at the base of the apparatus. Each ballast tank consists of a closed top end with a nozzle for admitting or releasing air, a closed bottom end save for a small orifice for water to flow into and out of the cylindrical ballast tank, a pressure gauge controllably connected to the internal cavity of the top end of the ballast, which controls water added or removed from the inside of the tank in a controlled response to the internal air pressure of ballast tank.

The present novel method and mobile apparatus will create a zone of intense mixing at an intensity higher than that which occurs in typical combustion, where fuel gas and air are introduced in a combustion chamber to create efficient and clean combustion.

Accordingly, several advantages of the present invention and mobile apparatus are the ability 1) to enhance the effectiveness of clean combustion through air to fuel ratio control, and 2) to vary the air/fuel ratio by varying the height of the chamber air inlet gap to maximize radial inward velocity to assist in preventing flame propagation outside the combustion chamber, and 3) to maximize radial inward velocity to aid in dragging waste floating on water into the core of the reactor, and 4) to engage in both land and water application, and 5) to use natural draft, and 6) to stabilize combustion, and 7) to be produced with low production cost.

Accordingly, it is a primary objective of this invention to provide a mobile incinerator of combustible waste materials on land or sea, where combustion efficiency is high and aided by air/fuel control, via control of the height of the annular gap between vanes, and where flame stability and combustion can be maintained.

Another object of the invention is to provide an extremely strong vortex flow burner having an air induction system with control for greater efficiency of combustion having minimal moving parts and mobility.

These and other objects and advantages of the invention will become apparent ant the invention will become fully understood from the following drawings and descriptions.

DESCRIPTION

It is the purpose of this instant invention to define a process and illustrate a mobile apparatus that increases the cleanliness, efficiency and completeness of combustion of combustible material on a nominally planar (i.e. flat plane) surface, by controlling the air flow into a vortex combustion chamber by varying the height of the air gap through the vertical vanes.

A preferred embodiment of the present invention shall be a combustion device for the clean incineration of combustible waste material on a nominally planar surface, comprising a cylindrical combustion chamber, said chamber including a circular outlet at one end for discharging combustion products therefrom, and a circular inlet at the end opposite said outlet for the introduction of swirling air; and an air induction means communicating with said combustion chamber circular inlet for introducing air in a vortex into said combustion chamber, said induction means comprising an elongated cylindrical sleeve of substantially uniform diameter throughout its length corresponding in diameter substantially to the diameter of said circular inlet; a plurality of circumferentially spaced tangential air inlet vanes extending outwardly from the outer surface of said cylindrical sleeve for admitting air tangentially in a spiral vortex to said sleeve with a maximum vortex effect.

The word "tangential" is employed to describe the direction given to the air entering or passing through the vanes into its chamber air inlet. Since the outer circumference of the cylindrical sleeve defines an assumed circle form which vanes depend, the entering air is given a whirling motion the direction of which may be said to be nearly tangential to this assumed circle. Vanes have been described as being adjusted to a converging angle. Such a converging angle is inclusive in a preferred form of this invention. A preferred angle of the said vanes shall be between 30 and 60 degrees to the tangent of the cylindrical sleeve.

In an embodiment of the invention, the air entering through its chamber air inlet, that passes through an azimuthal array of vertical vanes, will then after be impeded by a plurality of vertical pipes, collectively defined as a "bluff body", before entering the combustion chamber. The plurality of vertical pipes will preferably be evenly spaced apart, with the preferred spacing between vertical pipes occurring at 15 degrees from the axial midline of the combustion chamber.

The sharp velocity gradient of the rotating mass of air breaks up the streams of fuel into fine particles which migrate outward due to centrifugal force. This mixture of fuel and air is readily ignitable and is carried forward by the axial motion of the air in a substantially vortical manner into the combustion chamber.

Air control delivery is an important feature of this invention. Variations in the rate of air flow to the combustion chamber provide variations in the combustion process and pattern. In a preferred form of this invention, combustion air delivered is proportioned between the vanes annularly placed at the base of the circular inlet of combustion chamber. Control of air delivery may be by means of the proportioning of the relative size of air openings. Alternatively suitable means may be employed to vary the air supplied from the opening between the vanes.

The motive power for the introduction of fresh combustion air and turbulence is the natural draft created in the hot, insulated stack. Natural draft is proportional to the height and temperature of the stack. The minimum practical height of the stack would be four (4) feet.

The primary operation of this invention will be to change the height of the apparatus, relative to the air gap, to vary the air to fuel ratio inside the combustion chamber.

Control of air delivery by the proportioning of the relative size of the air openings may be accomplished in the water application of the invention by varying the height of apparatus, relative to the air gap, through the use of a means to raise or lower physical items into and out of the water, where one means is a ballast, which consists of a cylindrical tank, closed at the top with a nozzle for admitting or releasing air. With a ballast means to raise and lower the invention, the cylindrical tank is closed at the bottom, except for an orifice that allows water to flow into and out of the bottom of the cylinder. The water in the bottom of the cylinder is controllably admitted into and expelled out of the cylinder by the downward force on the ballast, counter-acted upon by the air pressure within the ballast tank. The desirable amount of water in the cylinder is based upon the desired submergence depth of the ballast in the water, which is equally defined as the desired height of the apparatus above the water, where the ballast is immovably connected to the apparatus. The air pressure within the ballast controls the amount of water in the cylinder, and the air pressure is controllably admitted into and expelled out of the cylinder through the nozzle at the top of the cylinder. A pressure gauge is included to provide process control feedback of the pressure inside the cylinder.

Control of air delivery by the proportioning of the relative size of the air openings may be accomplished in the land application of the invention by varying the height of the air gap, by varying the height of the vanes, through the use of a height control means to raise and lower physical items off and onto the ground, where one means may be moveable wheeled vertical struts or adjustable-length wheeled struts.

The angle of the vanes may be modified by placing at correct angles to obtain the vortical flow desired. A preferred embodiment of the angle of the vanes is between a 30-to-60-degree angle to the tangent of the outer circumference of the apparatus.

For the water application of this invention, the vanes shall be of a rigid material that may enter the water at differing depths. For the land application of this invention, the vanes may be of a flexible, yet sturdy, material or composition that allows the vanes to fold upon itself when it is lowered to the ground and extend itself when raised to the ground, and that allows the vanes to effectively channel chamber inlet air into the combustion chamber while the vanes are angled against the forces of the incoming chamber inlet air. While various flexible and sturdy vane materials and compositions are effective, a preferred option for this material is a tightly woven chain-link mesh.

In the preferred embodiment and any modifications, a standard means of ignition may be used.

DRAWINGS

FIG. 1 is a perspective plan view of the apparatus.

The presently preferred embodiment of the apparatus herein to increase combustion efficiency of combustible material on a nominally planar surface, through air intake control, according to the invention is shown in FIG. 1.

FIG. 2 is a perspective side view of the apparatus.

FIG. 3 is a perspective bottom view of the apparatus.

FIG. 4 is a portion of a view of FIG. 3 enlarged for magnification purposes.

FIG. 5 is a perspective bottom view of an embodiment of the apparatus with a bluff body.

FIG. 6 is a portion of a view of FIG. 5 enlarged for magnification purposes.

FIG. 7 is a perspective plan view of an embodiment of apparatus with a bluff body FIG. 8 is a longitudinal section view of the apparatus.

FIG. 9 is a longitudinal section view of the ballast tank.

FIG. 10 is a top view of the apparatus.

DRAWING REFERENCE NUMERALS

11 apparatus
12 chamber air inlet
13 vertical vanes
14 interface of apparatus and nominally planar surface
15 nominally planar surface
16 combustion chamber
17 cylindrical wall of combustion chamber
18 conduit means
19 ignition means
20 apparatus with a bluff body
21 vertical pipes forming bluff body
22 internal wall of the insulated stack
23 external wall of the insulated stack
24 insulation means
25 axial midline of the combustion chamber
26 preferred spacing of 15 degrees between each vertical pipe forming bluff body
27 base of the combustion chamber
28 top of the combustion chamber
31 cylindrical ballast
32 nozzle
33 air into ballast
34 pressure gauge means
35 orifice hole for water to pass into and out of the bottom of cylindrical ballast
36 air out of ballast
37 air pressure inside the ballast
38 ocean water level
39 upward/counterforce against downward force on the ballast by the apparatus
40 downward force on the ballast by the apparatus
41 height of apparatus above the planar surface
42 water into the ballast
43 water out of the ballast

DETAILED DESCRIPTION OF ILLUSTRATIVE EMBODIMENTS

A method and mobile apparatus to increase the efficiency and cleanliness of in-situ combustion of combustible material on a nominally planar surface, through the cost-effective control of air into a cylindrical combustion chamber, driven by a natural draft of tangential air flow, that creates a spiral of air flow within the chamber, according to a preferred embodiment of the present invention, will now be described with reference to FIGS. 1-9.

Referring now to FIG. 1 of the drawings, a perspective plan view of the apparatus 11, the apparatus 11 will receive the air through its chamber air inlet 12 that passes through an azimuthal array of vertical vanes 13 at the interface 14 of the apparatus 11 and nominally planar surface 15, so that the air may enter the combustion chamber 16 with a spin radial along the cylindrical wall of the combustion chamber 17. The combustion chamber 16 will receive some ignition fuel through multiple conduit means 18 for a pilot light or other ignition means 19. Exhaust flue gas will travel out the apparatus 11 past the internal wall of the insulated stack 22.

Referring now to FIG. 2 of the drawings, a perspective side view of the apparatus, the apparatus 11 will receive air through its chamber air inlet 12 that passes through an azimuthal array of vertical vanes 13 at the interface 14 of the apparatus and nominally plan surface 15, so that the air may enter the combustion chamber 16. After combustion, exhaust flue gas will travel out the apparatus 11 past the internal wall of the insulated stack 22.

Referring now to FIG. 3 of the drawings, a perspective plan bottom view of the apparatus 11, the apparatus 11 will receive the air through its chamber air inlet 12 that passes through an azimuthal array of vertical vanes 13 under the base of the apparatus 27, so that the air may enter the combustion chamber 16 with a spin radial along the cylindrical wall 17 of the chamber 16. The combustion chamber will receive some ignition fuel through multiple conduit means 18 for a pilot light or other ignition means 19. After combustion, exhaust flue gas will travel out the apparatus 11 past the internal wall of the insulated stack 22.

Referring now to FIG. 4 of the drawings, a portion of a view of FIG. 3 enlarged for magnification purposes, the apparatus 11 will receive the air through its chamber air inlet 12 that passes through an azimuthal array of vertical vanes 13 under the base of the combustion chamber 27, so that the air may enter the combustion chamber 16 with a spin radial along the cylindrical wall 17 of the chamber 16. The combustion chamber will receive some ignition fuel through multiple conduit means 18 for a pilot light or other ignition means 19. After combustion, exhaust flue gas will travel out the apparatus 11 past the internal wall of the insulated stack 22.

Referring now to FIG. 5, a perspective bottom view of an embodiment of apparatus with bluff body 20, the apparatus 11 will receive air through its chamber air inlet 12 that passes through an azimuthal array of vertical vanes 13 under the base of the combustion chamber 27, and be impeded by a plurality of vertical pipes 21, collectively defined as a "bluff body", before entering the combustion chamber 16. The combustion chamber will receive some ignition fuel through multiple conduit means 18 for a pilot light or other ignition means 19. After combustion, exhaust flue gas will travel out the top of apparatus 11 past the internal wall of the insulated stack 22.

Referring now to FIG. 6, a portion of a view of FIG. 5 enlarged for magnification purposes, the apparatus with a bluff body 20 will receive air through its chamber air inlet 12 that passes through an azimuthal array of vertical vanes 13 under the base of the combustion chamber 27, so that the air may enter the apparatus 11 and be impeded by a plurality of vertical pipes 21, collectively defined as a "bluff body", before entering the combustion chamber 16. The combustion chamber will receive some ignition fuel through multiple conduit means 18 for a pilot light or other ignition means 19. After combustion, exhaust flue gas will travel out the top of the apparatus 11 past the internal wall of the insulated stack 22.

Referring now to FIG. 7, a perspective plan view of an embodiment of the apparatus with a bluff body, the apparatus with a bluff body 20 will receive air through its chamber air inlet 12 that passes through an azimuthal array of vertical vanes 13, so that the air may enter the apparatus 11 and be impeded by a plurality of vertical pipes 21, alongside a conduit means 18, collectively defined as a "bluff body", before entering the combustion chamber 16. The combustion chamber will receive some ignition fuel through multiple conduit means 18 for a pilot light or other ignition means 19. After combustion, exhaust flue gas will travel out the top of the apparatus 11 past the internal wall of the insulated stack 22.

Referring now to FIG. 8 of the drawings, a longitudinal section of the apparatus, the apparatus 11 will receive air through its chamber air inlet 12 that passes into the combustion chamber 16 under the base of the combustion chamber 27 through the cylindrical wall of the combustion chamber 17. After combustion, exhaust flue gas will travel out the top of the apparatus 11 past the internal wall of the insulated stack 22.

Referring now to FIG. 9 of the drawings, a longitudinal section view of the ballast tank 31 which controls the height 41 of the apparatus above the planar surface 15, is uniformly positioned at the base of the combustion chamber 27 at the interface 14 of the apparatus and the nominally planar surface 15 which can be the ocean water level 38 during the cleanup of an oil-spill, shows the nozzle 32 at the top of the ballast 31 that admits air 33 into the ballast 31 and releases air out of the ballast 36, and a pressure gauge means 34 to provide feedback control data for the air pressure 37 inside the ballast 31, and an orifice hole 35 where water will pass into 42 and out of 43 the bottom of the cylindrical ballast 31.

Also referring to FIG. 9 of the drawings, a longitudinal section view of the cylindrical ballast 31 shows the forces acting on the ballast 31, where the air pressure inside the ballast 37 provides a counterforce 39 against the downward force 40 on the ballast 31 by the apparatus 11.

Referring now to FIG. 10 of the drawings, a top view of the apparatus with a bluff body 20 shows a plurality of vertical pipes forming a "bluff body" 21, alongside a conduit means 18, where the vertical pipes forming a "bluff body" 21 will preferably be spaced evenly apart at a preferred spacing 26 of fifteen degrees from the axial midline of the combustion chamber 25. The apparatus with a bluff body 20 will receive air through its chamber air inlet 12 that passes through an azimuthal array of vertical vanes 13, so that the air may enter the apparatus 11 and be impeded by a plurality of vertical pipes 21, before entering the combustion, chamber 16.

While other modifications of this invention and variations of the method and apparatus that may be employed within the scope of the invention have not been described, the invention is intended to include all such as may be embraced within this patent application.

What is claimed is:

1. An apparatus for improving in-situ combustion of a combustible material lying on a nominally planar surface, comprising:

(a) a cylindrical central combustion chamber having a chamber inlet and chamber outlet at opposed axial ends of the combustion chamber;

(b) an insulated stack tower that extends vertically from the combustion chamber, axially opposed to the chamber inlet, with an open exhaust end;

(c) said chamber inlet comprising an air inlet;

(d) said air inlet comprising a plurality of chamber air inlets made of an azimuthal array of vertical vanes circumferentially placed around a base of the combustion chamber, to direct air in a vortical rotating manner into the combustion chamber;

(e) said vanes supported vertically from the base of the combustion chamber at a converging angle, measured from a tangent line to the circumferential wall of the combustion chamber;

(f) said vanes pivotally supported to adjust the converging angle;

(g) a conduit means providing ignition fuel to the combustion chamber;

(h) said chamber air inlets to supply air necessary for combustion of said fuel;

(i) a gas flow passage for air, fuel, and combustion gas to flow through said combustion chamber and through the stack tower from the chamber inlet to the stack tower open exhaust end;

(j) said insulated stack tower comprises an internal wall, and an external wall;

(k) an insulation means for providing insulation of the stack tower, having insulating qualities greater than the sum of the insulation qualities of the individual portions of the internal and external wall of the stack tower;

(l) an ignition means for the combustion of said ignition fuel;

(m) a level control means to change the height of said vanes above the planar surface.

2. An apparatus for improving in-situ combustion of a combustible material lying on a nominally planar surface, comprising:

(a) a cylindrical central combustion chamber having a chamber inlet and chamber outlet at opposed axial ends of the combustion chamber;

(b) an insulated stack tower that extends vertically from the combustion chamber, axially opposed to the chamber inlet, with an open exhaust end;

(c) said chamber inlet comprising an air inlet;

(d) said air inlet comprising a plurality of chamber air inlets made of an azimuthal array of vertical vanes circumferentially placed around a base of the combustion chamber, to direct air in a vortical rotating manner into the combustion chamber;

(e) said vanes supported vertically from the base of the combustion chamber at a converging angle, measured from a tangent line to the circumferential wall of the combustion chamber;

(f) said vanes pivotally supported to adjust the converging angle;

(g) a conduit means providing ignition fuel to the combustion chamber;

(h) said chamber air inlets to supply air necessary for combustion of said fuel;

(i) a gas flow passage for air, fuel, and combustion gas to flow through said combustion chamber and through the stack tower from the chamber inlet to the stack tower open exhaust end;

(j) said insulated stack tower comprises an internal wall, and an external wall;

(k) an insulation means for providing insulation of the stack tower, having insulating qualities greater than the sum of the insulation qualities of the individual portions of the internal and external wall of the stack tower;

(l) an ignition means for the combustion of said ignition fuel;

(m) a cylindrical ballast fixedly attached to the base of the apparatus with the end of the ballast opposite said base of the combustion chamber interfacing with the nominally planar surface;

(n) said ballast comprising a nozzle at an external boundary of the ballast at a position axially opposed to the nominally planar surface for air to cross the external boundary of the ballast;

(o) said ballast further comprising a nozzle controller means controllably engaged to the nozzle, to control an amount of the air crossing the external boundary of the ballast;

(p) said ballast further comprising a ballast pressure gauge means to measure pressure of air inside the ballast;

(q) said ballast further comprising an orifice hole at the external boundary of the ballast axially opposed to said nozzle, for water to cross the external boundary of the ballast;

(r) said ballast pressure gauge means cooperating with the nozzle controller means to provide control data to the nozzle controller means.

3. The apparatus for improving in-situ combustion of a combustible material lying on a nominally planar surface as set forth in claim 1, wherein said converging angle is between 30 and 60 degrees, measured from a tangent line to the circumferential wall of the combustion chamber.

4. The apparatus for improving in-situ combustion of a combustible material lying on a nominally planar surface as set forth in claim 2, wherein said converging angle is between 30 and 60 degrees, measured from a tangent line to the circumferential wall of the combustion chamber.

5. The apparatus for improving in-situ combustion of a combustible material lying on a nominally planar surface as set forth in claim 1, further comprising vertical pipes circumferentially placed around the combustion chamber, internal to the air inlet, forming a bluff body to separate an air inlet air flow.

6. The apparatus for improving in-situ combustion of a combustible material lying on a nominally planar surface as set forth in claim 2, further comprising vertical pipes circumferentially placed around the combustion chamber, internal to the air inlet, forming a bluff body to separate an air inlet air flow.

7. A method for improving in-situ combustion of a combustible material lying on a nominally planar surface, by improving the efficiency of combustion within a mobile combustion chamber, including the step of (a) providing a mobile apparatus for improving in-situ combustion of a combustible material lying on a nominally planar surface comprising (1) a cylindrical central combustion chamber having a chamber inlet and chamber outlet at opposed axial ends of the combustion chamber;

(2) an insulated stack tower that extends vertically from the combustion chamber, axially opposed to the chamber inlet, with an open exhaust end;

(3) said chamber inlet comprising an air inlet;

(4) said air inlet comprising a plurality of chamber air inlets made of an azimuthal array of vertical vanes circumferentially placed around a base of the combustion chamber, to direct air in a vortical rotating manner into the combustion chamber;

(5) said vanes supported vertically from the base of the combustion chamber at a converging angle, measured from a tangent line to the circumferential wall of the combustion chamber;

(6) said vanes pivotally supported to adjust the converging angle;

(7) a conduit means providing ignition fuel to the combustion chamber;

(8) said chamber air inlets to supply air necessary for combustion of said fuel;

(9) a gas flow passage for air, fuel, and combustion gas to flow through said combustion chamber and through the stack tower from the chamber inlet to the stack tower open exhaust end;

(10) said insulated stack tower comprises an internal wall, and an external wall;

(11) an insulation means for providing insulation of the stack tower, having insulating qualities greater than the sum of the insulation qualities of the individual portions of the internal and external wall of the stack tower;

(12) an ignition means for the combustion of said ignition fuel;

(13) a level control means to change the height of the said vanes above the planar surface.

8. The method as set forth in claim 7, further comprising the step of controlling the height of the vanes above the planar surface with a cylindrical ballast fixedly attached to the base of the apparatus with the end of the ballast opposite said base of the combustion chamber interfacing with the nominally planar surface, comprising (a) a nozzle at an external boundary of the ballast at a position axially opposed to the nominally planar surface for air to cross the external boundary of the ballast, (b) a nozzle controller means controllably engaged to the nozzle, to control an amount of the air crossing the external boundary of the ballast, (c) a ballast pressure gauge means to measure pressure of air inside the ballast, (d) an orifice hole at the external boundary of the ballast axially opposed to said nozzle, for water to cross the external boundary of the ballast, (e) the ballast pressure gauge means cooperating with the nozzle controller means to provide control data to the nozzle controller means.

9. The method as set forth in claim 7, further comprising a converging angle between 30 and 60 degrees, measured from a tangent line to the circumferential wall of the combustion chamber.

10. The method as set forth in claim 7, further comprising the steps of (a) providing an apparatus wherein said converging angle is between 30 and 60 degrees, measured from a tangent line to the circumferential wall of the combustion chamber;

(b) controlling the height of the vanes above the planar surface with a cylindrical ballast fixedly attached to the base of the apparatus with the end of the ballast opposite said base of the combustion chamber interfacing with the nominally planar surface, comprising (1) a nozzle at an external boundary of the ballast at a position axially opposed to the nominally planar surface for air to cross the external boundary of the ballast, (2) a nozzle controller means controllably engaged to the nozzle, to control an amount of the air crossing the external boundary of the ballast, (3) a ballast pressure gauge means to measure pressure of air inside the ballast, (4) an orifice hole at the external boundary of the ballast axially opposed to said nozzle, for water to cross the external boundary of the ballast, (5) the ballast pressure gauge means cooperating with the nozzle controller means to provide control data to the nozzle controller means.

11. The method as set forth in claim 7, further comprising vertical pipes circumferentially placed around the combustion chamber, internal to the air inlet, forming a bluff body to separate an air inlet air flow.

12. The method as set forth in claim 7, further comprising the steps of (a) providing an apparatus comprising vertical pipes circumferentially placed around the combustion chamber, internal to the air inlet, forming a bluff body to separate an air inlet air flow;

(b) controlling the height of the vanes above the planar surface with a cylindrical ballast fixedly attached to the base of the apparatus with the end of the ballast opposite said base of the combustion chamber interfacing with the nominally planar surface, comprising (1) a nozzle at an external boundary of the ballast at a position axially opposed to the nominally planar surface for air to cross the external boundary of the ballast, (2) a nozzle controller means controllably engaged to the nozzle, to control an amount of the air crossing the external boundary of the ballast, (3) a ballast pressure gauge means to measure pressure of air inside the ballast, (4) an orifice hole at the external boundary of the ballast axially opposed to said nozzle, for water to cross the external boundary of the ballast, (5) the ballast pressure gauge means cooperating with the nozzle controller means to provide control data to the nozzle controller means.

* * * * *